United States Patent [19]

Zundel

[11] 4,132,328

[45] Jan. 2, 1979

[54] PANEL WITH OPENING MEANS

[75] Inventor: Arthur P. Zundel, Mt. Prospect, Ill.

[73] Assignee: National Can Corporation, Chicago, Ill.

[21] Appl. No.: 873,547

[22] Filed: Jan. 30, 1978

Related U.S. Application Data

[63] Continuation-in-part of Ser. No. 789,096, Apr. 20, 1977, abandoned.

[51] Int. Cl.[2] ..... B65D 41/32

[52] U.S. Cl. ..... 220/267; 220/268

[58] Field of Search ..... 220/266–273, 220/277, 336, 345, 346; 222/541; 229/7 R

[56] References Cited

U.S. PATENT DOCUMENTS

| | | | |
|---|---|---|---|
| 3,934,750 | 1/1976 | Herbst | 220/268 X |
| 3,938,693 | 2/1976 | Patel et al. | 220/267 |
| 4,023,703 | 5/1977 | Strobe et al. | 220/268 |
| 4,039,101 | 8/1977 | Wells | 220/269 |

*Primary Examiner*—George T. Hall

*Attorney, Agent, or Firm*—Robert A. Stenzel; Ralph R. Rath

[57] ABSTRACT

An easy open ecology end is disclosed herein and includes an end panel that has a removable section defined by a weakened score line. A tab is secured to the removable section and the tab and removable section are designed so that both remain captive with respect to the end panel when the weakened score line is severed. The weakened score line is produced by a unique three step process and has an area of reduced residual which is first severed when a force is applied to the tab so that the container is vented before the remainder of the residual is severed. The tab is designed to produce a localized initial pressure to initially sever the area of reduced residual and then sever the remainder of the score line.

39 Claims, 28 Drawing Figures

32
2
30
64
66
68
36
46
220
203
224
72
34
226
1 ST PUSH BUTTON DOWN
2 ND SLIDE BACK
3
3
202
78
226
48
228
66
64
68
2

66
30
32
64
46
66
64
68
68
34
40
48
42
70

46
209
208
226

224
212
210
228
229
74
74
34
214
206
202
204
48
40
42
76
78

46
209
210
226
224
228
34
212
44
40
78
48

54
84
80
88
86
82

106
104
100
102
94
96
98
90
92
50
80
116
110
112
114
40
118
122

80
116
40
136
132
140
144
138
142
134
146
130

PANEL WITH OPENING MEANS

REFERENCE TO RELATED APPLICATION

This application is a continuation-in-part of U.S. application Ser. No. 789,096 filed Apr. 20, 1977 now abandoned.

BACKGROUND OF THE INVENTION

For many years, can manufacturers have been producing cans having the familiar ring-pull and removable section which could be completely severed from the remainder of the container. Examples of end panels of containers having this type of removable section are disclosed in U.S. Pat. Nos. 3,445,029 and 3,428,210.

Since the container industry produces at least 46 billion cans annually for packaging soft drink and beer, millions of these tear strips and tabs are left on beaches, parks, along highways and in campgrounds each year and these are not only unattractive but are also considered dangerous.

Thus, for nearly a decade, the can industry has attempted to develop non-detechable substitutes for the familiar pull-tab cans. One type of substitute that has been proposed is known as the "button" design wherein a weakened area is defined in the end panel of the container and the entire button is severed from the end panel and drops into the container. Examples of this type of substitute are shown in U.S. Pat. Nos. 3,902,626, 3,902,627; and 3,982,657. The main problem with this type of design is that considerable pressure must be exerted to sever the weakened line when a pressurized carbonated beverage is packaged in the container. This type of container is also considered in some respects to be unsanitary since the "button" drops into the contents. One type of design which has been proposed in this category includes two openings in the end panel of different size, one providing a venting feature and the second for a pouring opening. This arrangement creates an additional problem in that the smaller "button" may come out of the larger hole with the contents. A further problem encountered with this type of closure or end panel is that the user may cut his finger during severing of the "button."

As a further alternative to the well known ring-pull tab, various other types of end panels have been proposed wherein a tab type unit is utilized for fracturing a weakened line and the tab is then used in supporting the severed portion on the container panel. This type of arrangement is disclosed in U.S. Pat. No. 3,236,409.

Other types of end closures have been proposed wherein the severed portion remains permanently attached at at least a localized area after fracture of the weakened area. Examples of this type of unit are disclosed in U.S. Pat. Nos. 3,946,683; 3,934,750; and 3,874,555.

While there have been literally dozens of proposed substitutes for the familiar severable tear strip with the attached tab, none of the proposed substitutes has received any substantial degree of commercial success because they are either too complicated to operate, too expensive to produce or are unsanitary during use. Thus, there remains a need for a non-detechable opening device which is capable of withstanding a required pressure without leaking, and also is capable of meeting the minimum pressure requirements with respect to "buckling" and "rock".

SUMMARY OF THE INVENTION

According to the present invention, a removable section is formed in a wall portion of a container by initially coining a peripheral inner closed area to a reduced thickness and then coining an outer closed area spaced from and surrounding the inner closed area. The inner closed area is then scored to produce a residual that defines the removable section.

According to one aspect of the invention, the residual between the removable section and the remainder of the wall portion has a substantially constant thickness along a major portion of the length thereof and also has at least one minor portion of less thickness than the major thickness. Thus, when a force is applied to the removable section, the residual will initially sever at the minor portion of lesser thickness to provide a vent for relieving pressure from inside the container and subsequently sever the remainder of the residual to completely separate the removable section from the remainder of the wall portion.

The removable section also has removal means in the form of a tab having a peripheral size larger than the size of the opening in the wall portion formed by severing the residual and has severing means which initially sever the residual of lesser thickness and then subsequently sever the remaining portion of the residual.

In one embodiment of the invention, the removal means or tab includes a body having a bead deformed toward the removable section which is aligned with the inner edge of the score to act as the severing means and the bead has at least one projection for applying localized pressure to the residual of lesser thickness. The body has severed spaced raised portions so that pressure applied to the body will initially be directed towards the desired area of the score line In another embodiment of the invention, the tab consists of a peripheral portion that extends substantially perpendicular to the wall portion and engages the outer surface of the wall portion at a location spaced from the score. The tab also includes an inner deflectable portion generally aligned with the inner edge of the score which, when depressed, severs the residual.

In a further version of the tab, the tab has a supporting portion engaging the wall portion outside the score with the tab having a downwardly directed wall portion aligned with the inner edge of the score and the downwardly directed wall portion has a major dimension aligned with the portion of minimum residual of the score and slopes upwardly away from the minimum portion.

In still another version of the tab, the tab has primary contact means or points for initially applying a localized pressure to an area of the score line that is of minimum thickness and secondary contact means or points that engage the removable disc at points spaced from the weakened score.

In all embodiments, the tab body is larger than the removable section and is secured to the center of the removable section through an integral rivet with a connecting means or tongue portion that is severed from the remainder of the tab body so that the tab and removable section can be moved to an offset position with respect to the opening in the wall portion after the removable section has been severed from the wall portion. In the stored condition, a major portion of the tab is located adjacent the outer surface of the wall portion of the container while the connecting portion and the removable section are located adjacent the inner surface of the wall portion of the container having the opening therein so that the removable section and tab are permanently retained on the wall portion having the opening therein.

According to another aspect of the invention, the wall portion surrounding the removable section is reinforced by at least a pair of strengthening beads that are deformed in the metal and extend generally parallel to each other outside the area of the removable section.

According to the method aspect of the present invention, a flat wall portion of substantially constant thickness is first coined to produce a substantially annular inner enclosed area of reduced thickness in at least one surface of the wall portion in a manner to flow the displaced metal into the circular area so that the portion inside the coined area is substantially concave in cross section and the metal is in compression. The metal wall portion is then coined outside the annular inner closed area of reduced thickness to displace additional metal into the removable section and place the metal further in compression. Thereafter, the inner coined area of reduced thickness is scored to produce a residual at the base of the score defining the removable section.

After the scoring tool is removed, it has been determined that the compressed metal in the removable section will expand and the flow of metal can be controlled to produce a locking feature between the removable section and the remaining wall portion of the container. Upon severing of the residual, the removable section will expand slightly thereby preventing removal of the removable section from the container.

DETAILED DESCRIPTION

Figure 1:
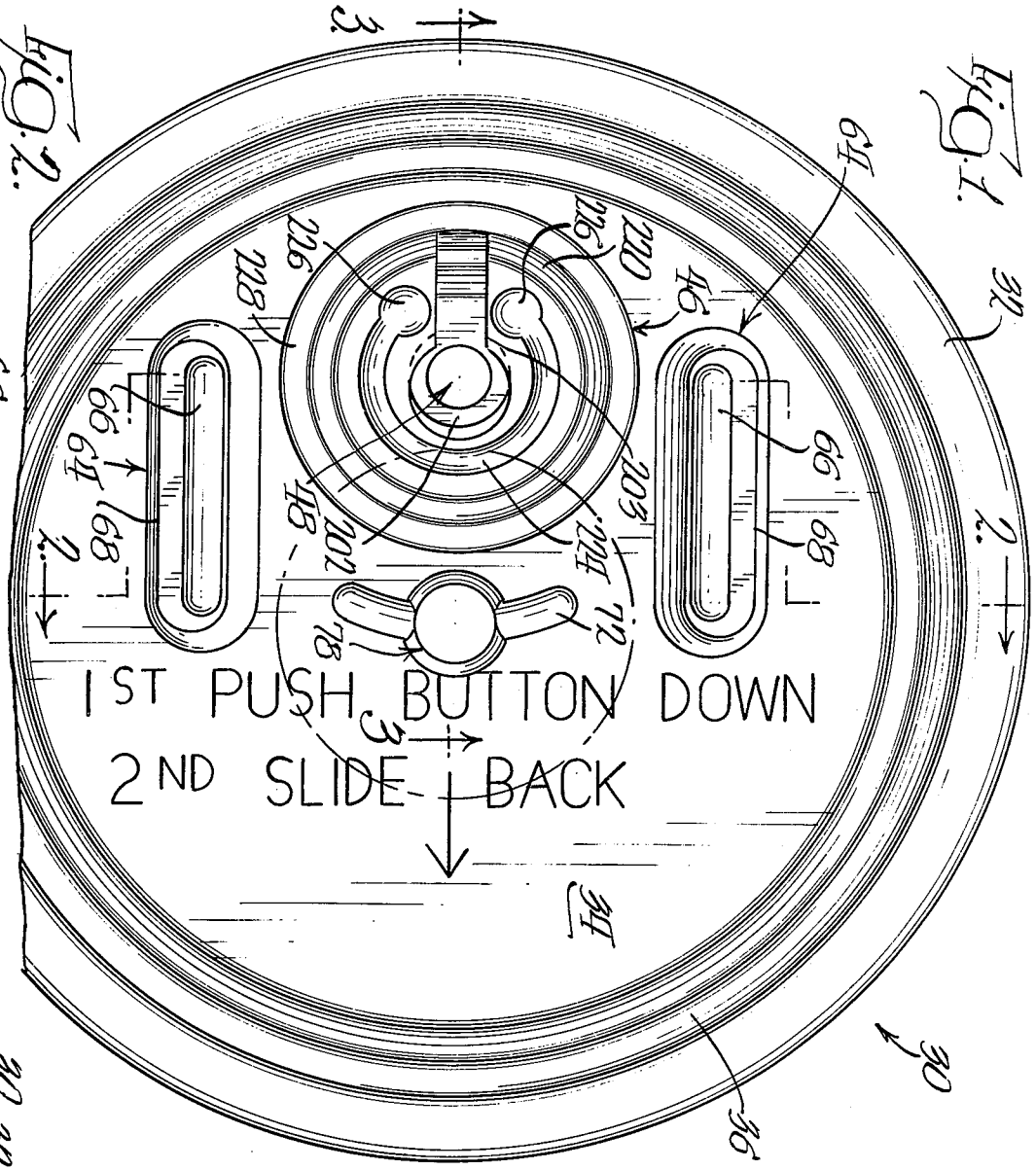
FIG. 1 shows a plan view of a container end having the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawing shows a wall portion of a container such as an ecology end panel generally designated by reference numeral 30. Ecology end panel 30 has a peripheral curl 32 adapted to be seamed to a container body (not shown), a central generally flat portion 34 and a countersink wall portion 36 joining flat portion 34 to peripheral curl 32.

Figure 3:
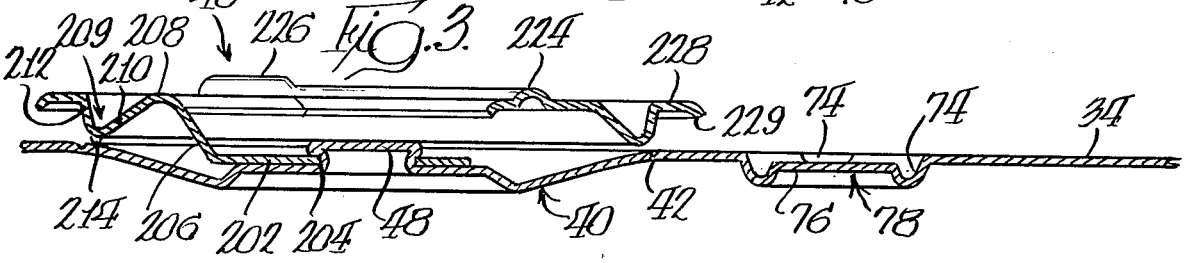
FIG. 3 is an enlarged fragmentary sectional view, as viewed along line 3—3 of FIG. 1.
Figure 4:
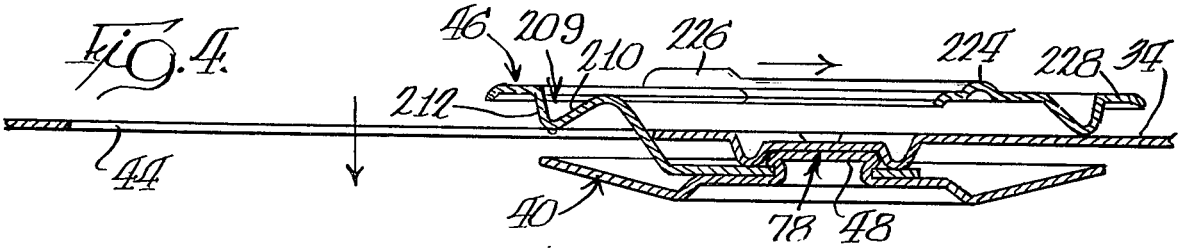
FIG. 4 is a sectional view similar to FIG. 3 showing the container end in an open position.

According to the present invention, central flat portion 34 has a removable section defined therein that is capable of being completely severed from the wall portion and is capable of being operatively retained on the wall portion while the opening created therein defines a means for removal of the contents. As shown in FIG. 3, removable section 40 is defines by a circular weakened line 42 that, when severed, will produce a circular opening 44, as illustrated in FIG. 4. Removable section 40 has removal or opening means 46 secured thereto through a rivet 48, as will be explained in more detail later.

According to one aspect of the invention, the weakened area is formed in a unique fashion to insure that the removable section can readily be completely severed from wall portion 34 with a minimum amount of force being applied thereto. However, before being severed, the container end 30 is capable of withstanding at least 90 PSI pressure within the container without causing the panel to "buckle" or "rock".

Figure 5:
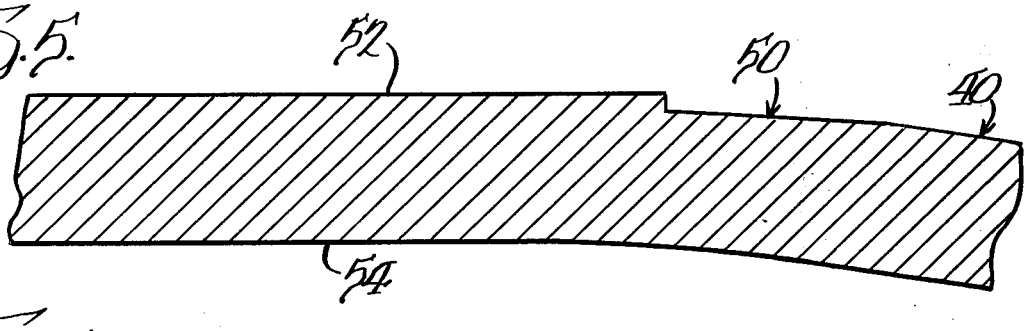
FIG. 5 is an enlarged fragmentary sectional view after the first step in forming the removable section.
Figure 6:
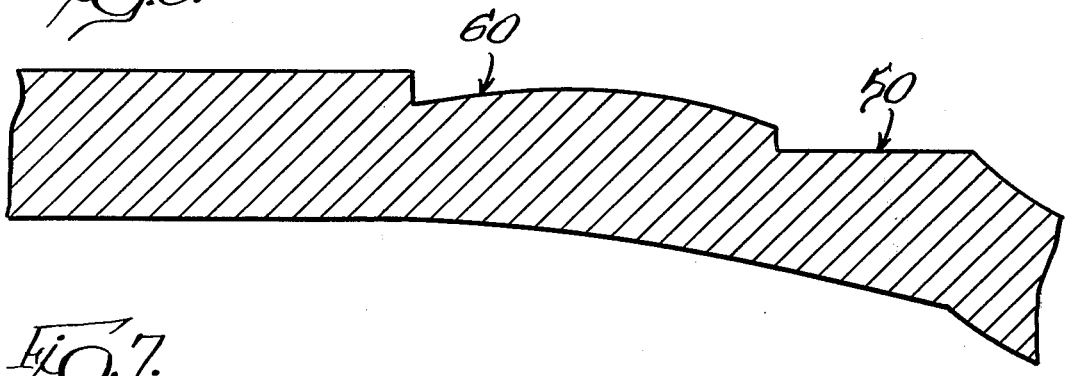
FIG. 6 is a view similar to FIG. 5 showing the panel after the second step in forming the removable section.
Figure 7:
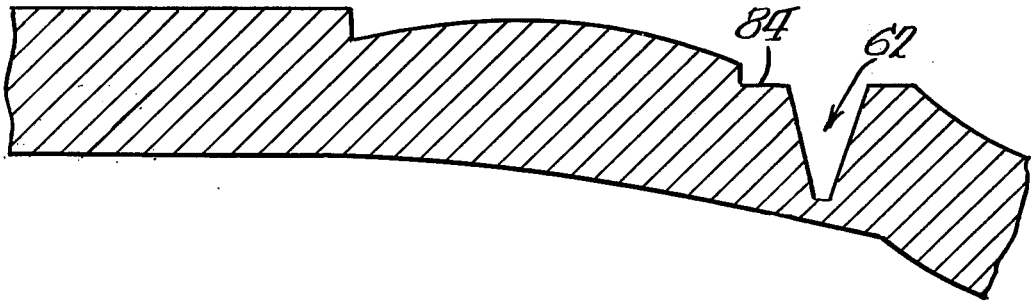
FIG. 7 is a view similar to FIG. 5 showing the final configuration of the weakened line.

As shown in FIGS. 5, 6 and 7, weakened line 42 is produced in a three-step process which has several distinct advantages, as will become apparent hereinafter. The first step in forming weakened line 42 is illustrated in FIG. 5 and consists of coining a substantially circular area to produce a flat annular reduced portion 50 on one surface, the outer public surface, of wall portion 34. During the formation of the first flat annular reduced portion 50, the metal which is displaced in the coining operation flows into removable section 40 and results in placing the metal in the removable section in compression and also causes the removable section or disc 40 to become concave in cross-sectional or dish-shaped.

It has been found that the amount of coining or reduction in wall thickness in the weakened area during the initial step will determine the amount of dishing effect that will occur in the removable section. The coining operation will result in work hardening of the metal in the annular area 50, which may be considered as making the material in the annular area 50 more brittle when compared with the remainder of the wall portion 34.

The next step in forming the removable section is to produce a second flat annular reduced portion or coin 60 surrounding and slightly spaced from the inner or first annular reduced portion 50. The metal that is displaced during coining of the second or outer flat annular reduced portion 60 again flows into the area inside reduced portion 60 and places the metal in the circular disc 40 further under compression, for a purpose that will be described later. During the formation of this outer flat annular reduced portion or outer coin 60, the area between inner and outer coins 50 and 60 is also reshaped so that the area between the two coins is inclined slightly with respect to panel portion 34. This feature is of significance as will be explained in more detail later.

The last step in forming the removable section 40 consists of producing a score 62 within the inner coin or first flat annular reduced portion 50, and score 62 defines the removable section or disc 40.

The final configuration of the weakened area is illustrated in an enlarged fragmentary view of FIG. 12 and the important advantages of deforming weakened line 42 in a three-step process will be described later.

Figure 2:
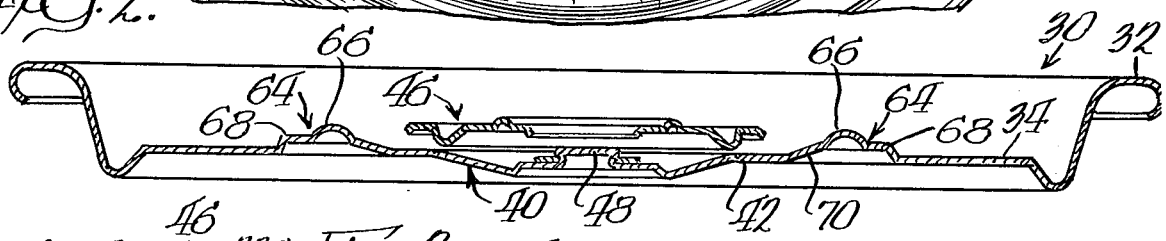
FIG. 2 is a sectional view, as viewed along line 2—2 of FIG. 1.

Panel portion 34 also has reinforcing means substantailly surrounding the entire removable section to insure that the panel portion 34 outside of weakened area 42 is sufficiently rigid to prevent deflection during the opening process. As more clearly shown in FIGS. 1 and 2, the reinforcing means includes a pair of reinforcing members 64 which extend parallel to each other and are located on opposite sides of removable section 40. Each reinforcing member 64 has an end portion extending beyond the center of the removable section (defined by rivet 48) so that a plane extending through the center of rivet 48 and perpendicular to reinforcing members 64 will intercept an end portion thereof.

Each reinforcing member 64 consists of an elongated primary element or bead 66 deformed from the body or wall portion 34 and a secondary element or bead 68 which surrounds primary element or bead 66. As more clearly illustrated in FIG. 2, secondary element or bead 68 has a flat inclined inner wall portion 70 located adjacent and in close proximity to weakened line 42 and it has been found that this flat inclined wall increases the rigidity of the panel adjacent opposite sides of removable section 40. This flat inclined wall portion 70 is believed to be beneficial in preventing premature rupture of the adjacent weakened line 42.

Reinforcing members 64 not only provide rigidity to panel portion 34, but also extend away from panel portion 34 a sufficient distance to have upper edges located above the upper surface of tab 46 and protect opening means or tab 46 during subsequent operations, shipment and storage after the end has been completed.

The reinforcing means also include an arcuate bead 72 that is deformed inwardly and surrounds removable section 40 at a location diametrically opposed to the periphery of panel end 30. As more clearly shown in FIGS. 1 and 3, arcuate reinforcing means 72 also has a circular depressed portion 74 and circular depressed portion 74 has a ceter portion 76 deformed upwardly to define a recess 78, for a purpose that will be described later.

Figures 8, 9, 10:
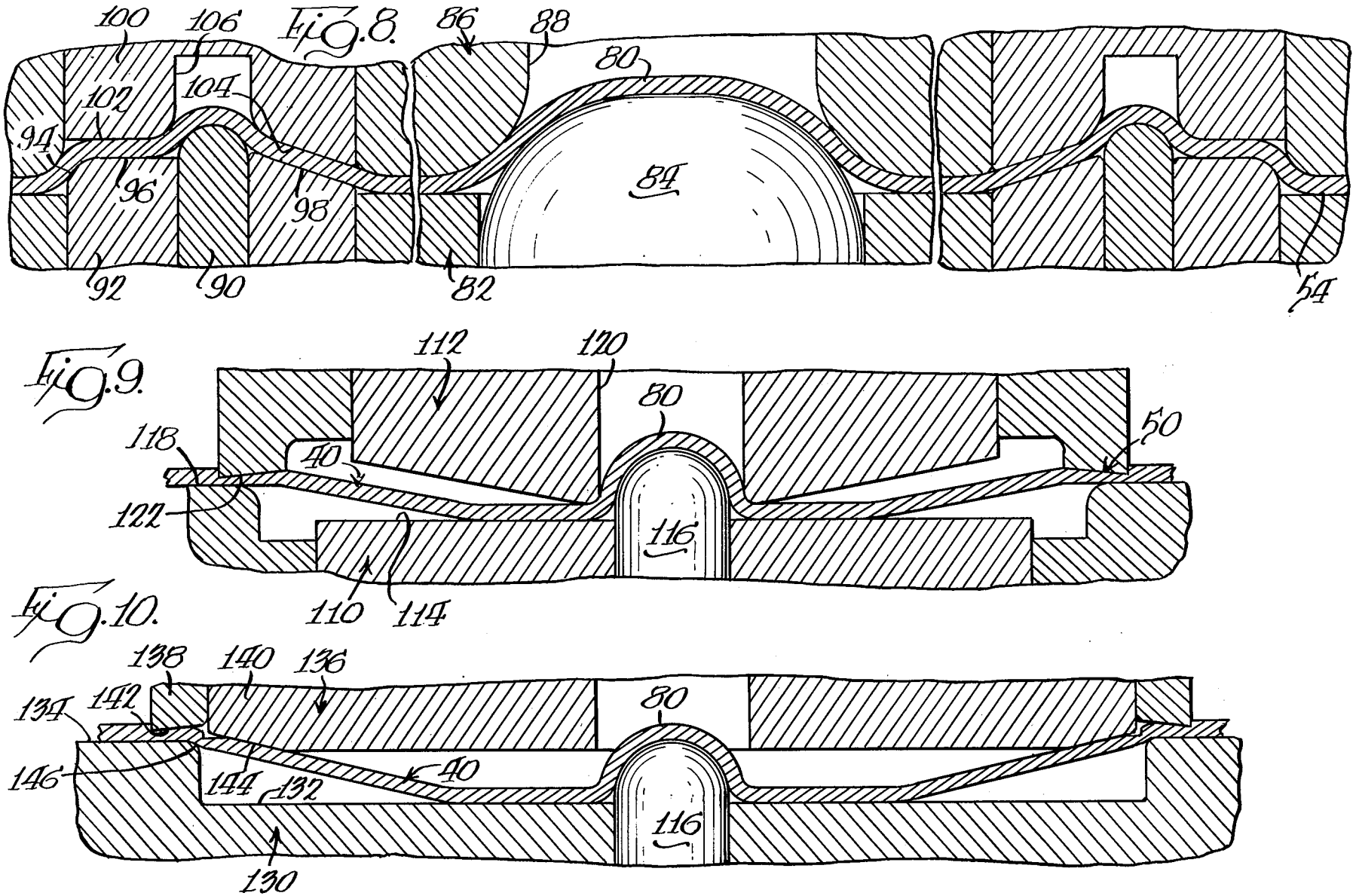
FIG. 8 is an enlarged fragmentary sectional view showing the tooling for the first step in forming the end panel.
FIG. 9 is a sectional view showing the tooling for the second step in the formation of the end panel.
FIG. 10 is a sectional view showing the tooling for the third step of forming the end panel.

Before considering the construction of the opening means or tab 46, the various operations for deforming a flat panel to a finished end will be described. The first step of converting a flat panel or blank to a finished end is illustrated in FIG. 8. In this operation, an initial blister 80 and reinforcing members 64 are formed utilizing cooperating die elements.

Considering first the formation of blister 80, which is positioned so that it will be located in the center of removable section 40, a lower die element 82, having a substantially spherical upwardly directed projection 84, is positioned adjacent lower surface 54 of panel portion 34 while an upper die element 86, having a substantially circular opening 88, is positioned adjacent upper surface 52 of panel portion 34. Thus, relative movement of die elements 82 and 86 towards each other will deform the flat panel and produce blister 80.

Simultaneous to the formation of blister 80, reinforcing members 64 are also formed in panel 34. For this purpose, lower die element 82 has an elongated member 90, which has an arcuate upper surface and is surrounded by a die element 92 having an arcuate surface 94 merging with a flat surface 96 on one side thereof while the opposite side has a flat inclined upper surface 98. Upper die element 86 has a member 100, which has a lower flat outer surface 102 that cooperates with flat surface 96, and an inclined surface 104 complimentary with surface 98 on the inner side thereof with a recess 106 between the two surfaces. Thus, relative movement of die members 82 and 86 will simultaneously produce blister 80 and both reinforcing members 64.

The next step in the conversion of a blank to a finished panel is the formation of inner coin 50 that is illustrated in FIG. 5 and deforming blister 80 to its final configuration before tab 46 is secured thereto, as will be described later. As shown in FIG. 9, inner coin or first flat annular reduced portion 50 and reformation of blister 80 are performed using a lower die element or member 110 and an upper die element or member 112. Lower die member 110 has a flat circular upper surface 114 in the center portion thereof with a spherical member 116 projecting above surface 114 at the center thereof. Lower die member 110 also has a flat peripheral annular surface 118 surrounding surface 114 and located at a higher level.

Upper die element or punch 112 has a center recess 120 aligned with spherical member 116 and a flat lower peripheral surface 122 which is preferably inclined and defines an angle of less than 5 degrees and preferably approximately one degree with respect to the planar horizontal surface 118 on the lower die element 110. Thus, movement of die members 110 and 112 towards each other will reshape blister 80 to the configuration illustrated in FIG. 9 and simultaneously produce the inner or first coin 50. It should be noted that utilizing a flat annular surface 122, which is slightly inclined, for coining a circular area of reduced thickness 50 insures that the metal which is displaced from the flat annular reduced portion 50 flows inwardly into removable section 40 and results in the removable section being transformed from a substantially flat portion to a dish-shaped or substantially concave configuration in cross section. To maintain an accurate control of the removable section 40, the center portion of removable section or disc 40 is flattened, as illustrated in FIG. 9, by flat surface 114. At the same time, because of the flow of the metal that is displaced, the metal in the removable section is placed under compression.

The next step in converting panel portion 34 consists of forming the outer coin or second annular portion 60. Simultaneous to the formation of outer coin 60, it has been found desirable to reshape the area between inner and outer coins 50 and 60. These steps are accomplished by utilizing tooling illustrated in FIG. 10. As shown in FIG. 10, a lower die element 130 has a center flat surface 132 with a spherical member 116 identical to the one utilized in the previous step aligned with the reformed blister 80. A second annular flat surface 134 surrounds the surface 132 and is spaced above surface 132.

Upper die member 136 has an outer annular punch 138 and a center portion 140. Outer annular punch 138 again has an inclined surface 142 which is inclined less than 5 degrees, preferably approximately one degree, with respect to flat surface 134 so that relative movement of the die members toward each other will produce the outer coin 60. During the production of outer coin 60, the displaced metal again flows inwardly into removable section 40 to place the metal therein under further compression.

The reshaping or reforming of the area between inner and outer coins 50 and 60 is accomplished with an annular inclined surface 144 which cooperates with a radiused portion 146 on the inner edge of flat surface 134. Thus, the relative position of the two surfaces with respect to each other will determine the angle of inclination or "drape angle" (A, FIG. 12) that is developed between the inner and outer coins. This "drape angle" (A) has been found to be important in the formation of a satisfactory end that can be opened with a minimum amount of force. While the importance of the "drape angle" is not fully understood, it is believed that introducing the "drape angle" into the area between the two coins will result in having inner coined area 50 located below outer coined area 60, which is believed to be advantageous, for reasons that will be described below.

The next operation consists of forming the score line 62 to define the final finished removable section. This is accomplished with die elements as illustrated in FIG. 11. During the formation of score line 62, it is also desirable to simultaneously reform the center of the disc, as will now be explaned.

Figures 11, 11A, 12:
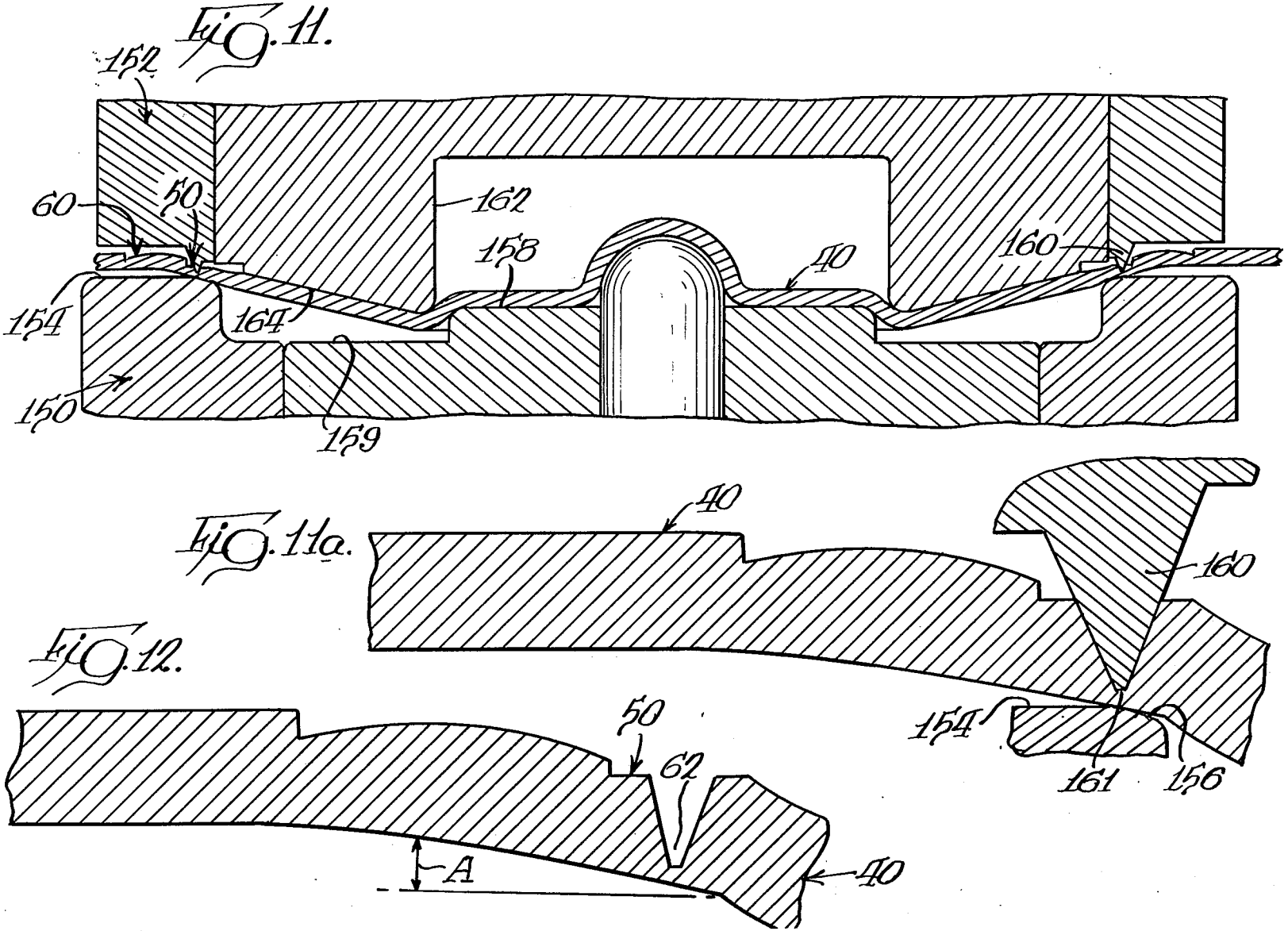
FIG. 11 is a sectional view showing the tooling for the final step of deforming the panel.
FIG. 11*a* is an enlarged fragmentary view showing details of the scoring tool.
FIG. 12 is an enlarged fragmentary sectional view showing the final configuration of the weakened area defining the removable section.

The score line 62 is formed with lower and upper die members 150 and 152 with lower die member 150 having a flat outer annular surface 154 which has a flat inclined inner edge or surface 156 (FIG. 11*a*). Inner surface 156 is preferably inclined approximately forty-five degrees with respect to outer annular surface 154. Lower die element also has one or more raised portions (not shown) extending above surface 154 and each raised portion circumscribes a small arc, as will be explained later. The center portion of lower die 150 has an elevated surface 158 located below surface 154 and the area between the surface is recessed at 159.

Upper die member 152 has a scoring punch 160 formed on the periphery thereof and punch 160 is substantially V-shaped in cross section. The lower edge of V-shaped punch 160 has a small flat portion 161 which is aligned with flat surface portion 154 and also is aligned with the raised portions. Upper die member 152 also has a center recessed portion 162 that is aligned with circular flat surface 158 and an inclined surface 164 surrounding recess 162. Thus, when die members 150 and 152 are moved towards each other, surfaces 158 and 164 will cooperate to raise the center portion of removable section to the position illustrated in FIG. 11.

During this relative movement, punch 160 produces a V-shaped score 62 in the inner coined area 50 and the metal that is displaced by the V-shaped scoring tool 160 again flows into the removable section 40, thus placing the metal in the removable section further under compression. During this operation, the one or more raised portions extending about surface 154 also cooperate with V-shaped scoring tool 160 to produce certain areas of minimum residual R1 (FIG. 20) which is slightly less than the residual of the remainder of the weakened line. Thus, the major portion of the residual defined by scoring tool 160 has a thickness R and each raised portion will produce a small area of minimum residual thickness R1.

It has been found desirable to have two diametrically opposed areas of reduced residual R1 each of which has a circumferential dimension of approximately one-quarter inch. Also, the residual R preferably has a thickness of approximately 0.0030 inches and the residual R1 has a thickness of approximately 0.0020 inches.

The areas of reduced residual R1 have two distinct advantages in producing an acceptable removable section for a container particularly of the type that has carbonated beverages under pressure packaged therein. The primary advantage is that it reduces the amount of pressure required to initiate rupture of the first portion of the residual or weakened line 42 and this is particularly true when the tab is configured to localize the forces exerted during initial rupture of the residual. Secondly and probably of even greater importance is the fact that the location of the initial rupture of the score can be predetermined and this initial rupture of the score at a localized area provides a vent for relieving the pressure of the contents in the container. This localized area can be positioned with respect to the tab to ensure that the product does not squirt beyond the tab, as will be explained later.

The final configuration of the removable section (before attachment of the tab thereto) is illustrated in FIG. 11 and the cross-sectional configuration of the area surrounding removable section 40 is illustrated in FIG. 12.

It has been determined that after the die elements 150 and 152 are separated, the compression of the metal in removable section 40, as well as the area between inner and outer coins 50 and 60, will result in a redistribution of the metal adjacent the score 62. It is believed that the compressive forces developed in the metal will actually result in having the outer wall of the V-shaped score 62 reoriented so that the angle between this wall and a vertical reference plane is actually reduced. In addition, it has been determined that the residual R will also be transformed and the lower flat wall portion of the V-shaped score will actually be inclined somewhat so that the metal from the removable section or disc will actually flow under the metal directly outside of score 62. Actual tests have determined that this redistribution of the metal in the residual R will produce a certain amount of overlap of the metal between wall portion 34 and removable section 40. This redistribution of the metal results in a locking feature between the exterior of the removable section or disc 40 and the remainder of wall portion 34.

These tests have shown that the panel formed in the manner described above has increased resistance to "buckle", which means the pressure that the end must resist before the dish-shaped removable section will begin to invert causing an initial point of failure of the residual or weakened line.

It is also believed that the "drape angle" of the area between inner and outer coins 50 and 60 increases the "buckle" resistance and, at the same time, reduces the forces required to rupture weakened line 42. While the "drape angle" has been found to be an important factor in determining the force required to rupture weakened line, the exact parameters of this angle have not been fully explored. Applicant has determined that the optimum "drape angle" in a sample end actually tested was 8 degrees and that this "drape angle" should in all instances be a small acute angle probably on the order of less than 15 degrees. If the angle becomes too large it has been determined that score line 62 cannot be severed with finger pressure that is normally applied to these ends. While this phenomenon is not completely understood, it is assumed that the larger angles inhibit the flow of metal from disc 40 under the periphery of the remainder of the panel and, in fact, the metal probably flows over the residual of score 62 to lock the removable section and thereby prevent downward movement of the disc.

The sequence of steps in forming the weakened line have been found to be important. It has been determined that the required force to sever score line 62 is less if the outer coin and the "drape angle" are formed before the score line is produced rather than after the score line. It should also be mentioned that forming score line 62 in the inner coined area 50 reduces the forces required for opening the end. This is because the work hardened material in coined area 50 and producing score line 62 results in making the metal in residual R and R1 more brittle and the residual metal will, therefore, crack rather than tear as is normal when the material is not coined before the score line is produced.

It should be pointed out that the steps of deforming the panel do not show the formation of arcuate reinforcing bead 72 and circular depression 74. These could be formed with reinforcing members 64 or when the lettering shown in FIG. 1 is formed in the metal. Also, in some instances it may be desirable to produce members 64 in two separate steps, i.e., first form primary beads 66 and then form secondary beads 68. The step of deforming blister 80 to rivet 48 has also not been shown since this is conventional in the art.

The details of the removal means or tab 46 will now be described in conjunction with FIGS. 1 through 4. Tab or opening means 46 consists of a substantially circular metal body which has a tongue portion 202 severed from the center thereof through a generally U-shaped slit 203 and tongue 202 remains integral with the tab body adjacent the periphery thereof. Tongue or connecting member 202 has an opening 204 (FIG. 3) which receives blister 80 that is subsequently deformed to form rivet 48 which defines a permanent connection between tab 46 and removable portion 40. Tongue 202 is substantially flat in the area surrounding the rivet 48 and has an upwardly directed inclined wall 206 which extends upwardly a sufficient distance to produce a flat portion 208 that is located approximately at the level of the upper surface of the periphery of tab 46. Tongue 202 then has a downwardly directed trough or bead 209 defined by wall portions 210 and 212. The lower surface of the downwardly directed bead 209 has a projection 214 extending downwardly and this projection is aligned with an area of reduced residual R1 of score line 62, for a purpose that will be described later.

Tab 46 also has a downwardly directed peripheral bead 220 extending the entire circumference of the tab and has end portions which terminate adjacent opposite edges of tongue 202 adjacent the integral connection thereof and bead 220 conforms generally to the configuration of bead 209 so as to define a continuation thereof. Circumscribing bead 220 is positioned so that the lower edge thereof is in direct alignment with the inner edge of weakened line 42, for a purpose that will be described later.

Tab 46 also has an upwardly directed bead 224 which is again circular in plan view and terminates at opposite ends on opposite sides of tongue 202. As shown in FIG. 3, the opposite ends of bead 224 have enlarged portions 226 that extend above the remainder of bead 224. The periphery of the body of tab 46 has a generally flat wall portion 228 located outside of bead 220 and a downwardly directed peripheral reinforcing edge 229.

In operation, the severing of weakened line 42 occurs through application of localized pressure at predetermined points with respect to the score line to insure that the initial rupture occurs at a predetermined location and the propagation of the rupture continues throughout 360 degrees of the score line. In this connection, the initial rupture and propagation of the initial rupture are accomplished by placing the thumb over the localized areas 208 and 226 and producing a downward force thereon. Since the severed tongue portion 202 is small when compared to the remainder of the tab, a greater resultant force is placed on portion 208 and tends to deflect the tongue portion slightly downwardly. This deflection of tongue 202 results in applying a localized force through projection 214 to an area of minimal residual R1 and results in an initial rupture of the score line. The continuation or propagation of the rupture results from the initial downward pressure on enlarged circular portions 226 so that the score line tends to be severed on both sides of the initial rupture and continues all the way around until the entire score line is severed. This can readily be accomplished by producing a downward force initially on the portions 208 and 220 and then turning the thumb slightly so that pressure is applied through the remainder of bead or raised portion 224. After the entire weakened line 42 has been severed, the removable portion or slug 40 will expand slightly because the material therein is under compression until the score line is severed, so that the diameter of the slug 40 is slightly greater than the diameter of the opening 44.

The next step in the opening process is to slide tab 46 and removable portion to the position illustrated in FIG. 4. During this sliding movement, the inclined upper surface of the inclined area directly outside weakened line 42 will act as a ramp for the lower edge of tab 46. In this position, opening 44 is substantially completely exposed for removal of the contents. It should be noted that in the final or stored position, removable portion 40 and tongue 202 are located on one side of panel portion 34 while tab 46 is located on the opposite side. In this stored position, rivet 48 is received into recess 78 so that the tab 46 and removal means 40 are locked in a stored position.

The tab or removal means 46 thus performs several important functions in conjunction with the removable means. The primary function of removal means or tab 46 is to sever weakened line 42. Another important function of the tab is to prevent the removable section from dropping into the contents of the container after being severed from the wall portion. The tab also acts as a cover for the area of the residual which is first severed to vent the container and cooperates with the removable section or disc to hold the disc on the wall portion or closure in a stored condition where opening 44 is exposed.

A slightly modified form of ecology end is illustrated in FIGS. 13–18. The primary distinction between the embodiment illustrated in these figures and the embodiment previously described is in the construction of the tab or opening means. In this embodiment, end panel 230 again has a peripheral curl 232 adapted to be seamed to a container body (not shown), a generally flat central portion 234 and a countersink wall portion 236 between panel portion 234 and peripheral curl 232. Central flat panel portion 234 again has a removable portion 240 which is defined by a circular weakened line 242. The weakened line is preferably formed in the same three step process as described above. The only distinction between removable portion 240 and removable portion 40 is that the center portion 243 surrounding rivet 248 is flat and is not recessed upwardly as in the previous embodiment. Also, reinforcing means 247 have been modified slightly in that the flat inclined innerwalls of the secondary beads have been eliminated and arcuate reinforcing bead 72 and circular portion 74 have been eliminated.

Figure 15:
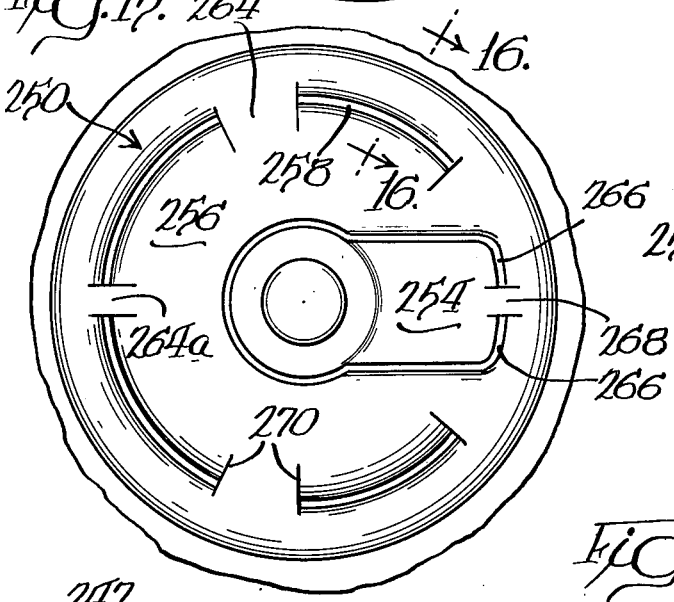
FIG. 15 is an enlarged fragmentary plan view showing the modified form of tab or opening means illustrated in FIG. 13.
Figure 16:
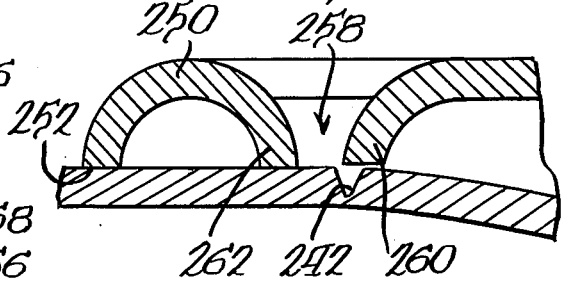
FIG. 16 is an enlarged sectional view as viewed along line 16—16 of FIG. 15.
Figure 17:
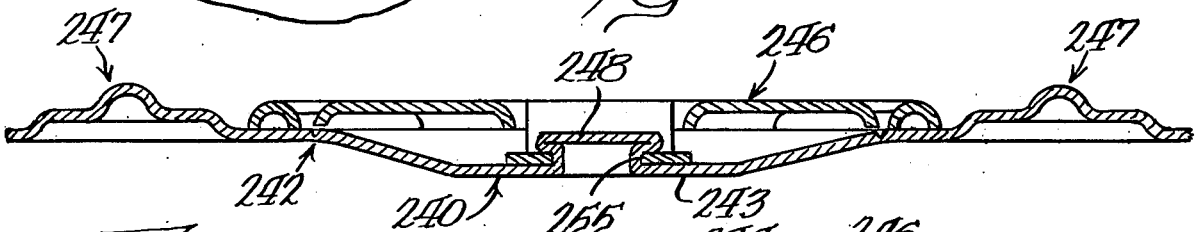
FIG. 17 is an enlarged sectional view as viewed along line 17—17 of FIG. 13.
Figure 18:
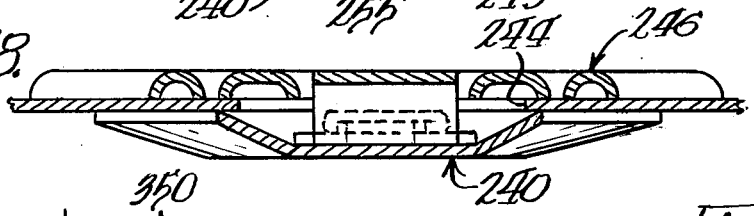
FIG. 18 is a sectional view as viewed along line 18—18 of FIG. 14.

The tab or removal means 246 is substantially different in construction but performs the same functions as described in connection with tab 46. FIGS. 15 and 16 show the details of removal means 246 which includes a continuous integral peripheral portion 250 that has a free edge 252 extending substantially perpendicular and supported on wall portion 234 outside weakened line 242. A tongue or connecting means 254 is severed from the main body of tab 246 and the free end portion of the connecting means or tongue 254 has an opening 255 (FIG. 17) through which tab 246 is permanently attached to the center of removable section 240 by rivet 248. Tab 246 also includes an inner deflectable portion 256 which is adapted to engage the removable section to sever residual R of weakened area 242. Tab 246 has a plurality of circumferential slits 258 which are produced by severing the main body of tab 246 at circumferentially spaced locations. The inner edges of slits 258 are deformed towards panel 234 to produce downwardly directed segments 260 that are aligned with the inner edge of weakened area 242. This relationship is most clearly illustrated in FIG. 16. Although not necessary, the outer edges of slits 258 are also preferably bent downwardly to produce downwardly directed segments 262 that reinforce the outer peripheral portion 250 of tab 246.

As can be seen from an inspection of FIG. 15, the areas between adjacent ends of adjacent pairs of circumferentially spaced severed slits 258 define integral connecting portions 264 between peripheral portion 250 and deflectable portion 256 of tab 246. To further increase the flexibility of deflectable portion 256 and also insure that the reduced residual R1 (at least one of which is located below the connecting portion or tongue 254) is initially severed, it is necessary to have the tongue portion cut out along arcuate slots 266 to produce downwardly directed segments that terminate close to the opposite ends of residual R1 and have their inner edges aligned with and engaging the removable section adjacent score line 242 in a fashion similar to that shown for segments 260. With this arrangement, the integral segment 268 between the two arcuate slots 266 will cover residual R1 and cover the initial vent opening when the residual R1 is severed. The same arrangement could apply to a second diametrically opposed reduced residual R1 that is located under connecting portion 264*a*. In the event that the two residuals R1 are circumferentially spaced 90 degrees, connecting portion 264*a* would also be spaced 90 degrees from connecting portion 268. If additional flexibility between deflectable portion 256 and peripheral portion 250 is required, the opposite ends of each slit 264 could be severed radially inwardly, as shown at 270.

Figure 13:
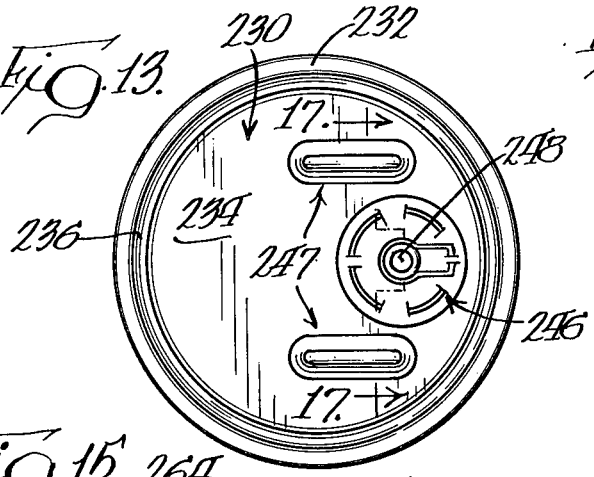
FIG. 13 is a plan view of a modified form of the end panel and opening means.
Figure 14:
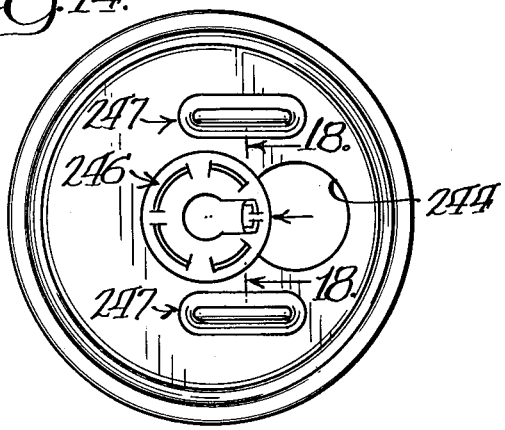
FIG. 14 is a view similar to FIG. 13 showing the panel end in an open condition.

Turning now to the opening procedure for severing removable section 240, it should be noted first that FIG. 13 illustrates approximately the full size of an end closure that is utilized in a conventional 12-ounce beer or beverage container. An inspection of this figure shows that the removal means or tab 246 has a size that is approximately the same size as the thumb of an adult. Thus, placing the thumb over the tab and exerting a downward force on tab 246 will result in producing localized areas of pressure on the respective reduced residuals R1 which will initially sever these two residual areas of reduced thickness. As explained above, these areas of reduced thickness not only ensure the initial fracture of the weakened area 242 at one or more desirable localized areas but also simultaneously produce vents in these local areas to relieve the pressure internally of the container.

Continued force on tab 246 will result in having the remainder of weakened area severed in opposite directions from each of the minor areas of reduced residual R1. This continued pressure or force on tab 245 will result in complete fracture of the weakened areas. It should again be noted that the work hardening of the material resulting first from the coining of inner area 50 and subsequently producing the score 242, results in the residual R having a substantially greater material hardness than wall portion 234. This, therefore, results in a cracking of the residual rather than a normal tearing action which would be the case if residual R were produced without the initial coining operation.

Because the removable section or disc 240 has compression stresses developed therein initially during the first coining and scoring operation and subsequently as a result of the second coining operation, the fracture of the residual R will result in relief of these internal stresses in disc 240 to thereby cause the size of disc 240 to increase a small amount. This small increase in size ensures that the disc cannot be removed through the circular opening 244. Of course, since tab 246 has a peripheral dimension greater than opening 244, the tab and removable section or disc 240 are held captive with respect to wall portion 234.

Figure 19:
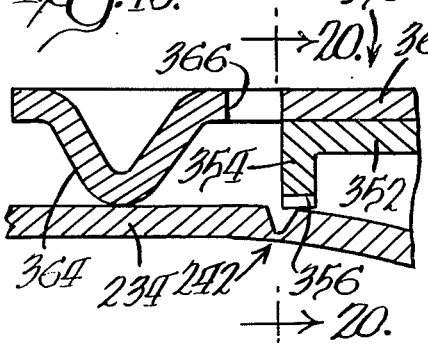
FIG. 19 is an enlarged fragmentary sectional view showing a further modified form of tab or opening means.
Figure 20:
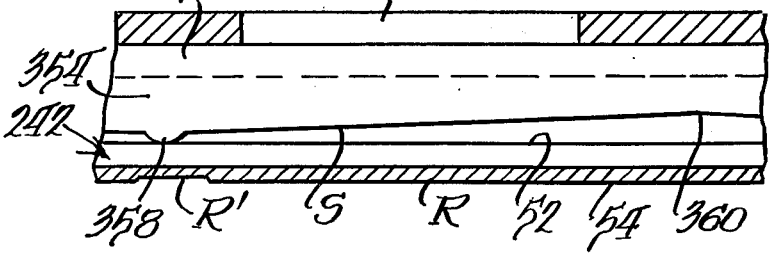
FIG. 20 is a fragmentary developed view of the weakeded area as viewed along line 20—20 of FIG. 19.

A further modified form of removal means is disclosed in FIGS. 19 and 20 which may be utilized with the removable section 40 or 240 in place of tab 46 or 246. Removal means 350 in this embodiment consists of a generally circular disc 352 (only a portion of which is shown) which has a peripheral portion 354 that extends substantially perpendicular to wall portion 234 and has a lower free end 356 that is generally aligned with the inner edge of weakened line 242. The free end of the vertically extending peripheral portion defines a surface S. The lower free end of the peripheral portion has a projection 58 that is generally aligned with the area of reduced residual R1 so that surface S is spaced a maximum dimension from disc 352 in the area of residual R1. As most clearly illustrated in FIG. 20, surface S is inclined and slopes away from projection 358 from the point of maximum dimension to a point of minimum dimension indicated at 360. The circumferential distance from projection 358 to the point 360 of surface S is 90 degrees and surface S likewise slopes in the opposite direction from the point of maximum dimension to the point of minimum dimension.

Circular disc 352 is connected to a plate-like member 362 which has a peripheral portion 364 that engages wall portion 234 in the area outside of weakened line 242. In order to allow relative movement between disc or deflectable portion 354 and peripheral portion 364, plate member 362 has a plurality of circumferentially spaced slots 366 aligned with the periphery of disc 352. These slots may take the general configuration illustrated for slots 258 in the embodiment shown in FIG. 15. Also, it is preferable that two projections 358 be located at diametrically opposed points on the circular peripheral perpendicular wall portion and that the residual have two diametrically opposed areas of reduced residual R1. Tab 350 is connected to removable section 240 utilizing a tongue (not shown) cut from circular disc 352 similar to tongue 254.

Thus, application of force to the upper surface of plate 362 will result in applying localized pressures to the two areas of reduced residual R1 to result in initial severance of these two areas and produce two opposed areas for venting of the pressure of the contents inside the container. Continued application of force to the top surface of plate 362 will result in having the entire weakened line 242 severed so that removable section 240 is separated from wall portion 234. After the removable section 240 has been severed from wall portion 234, the removal means and removable section can again be moved to an offset, stored position generally illustrated in FIGS. 14 and 18.

It should be pointed out that the inclined slope and projection of the peripheral perpendicular portion 354 could also be incorporated into the tab 246 illustrated in FIGS. 15–18. For example, the lower free ends of segments 260 could be sloped and have at least one projection aligned with each one of the areas of reduced residual to further ensure that this area is initially severed when force is applied to the tab.

Figure 21:
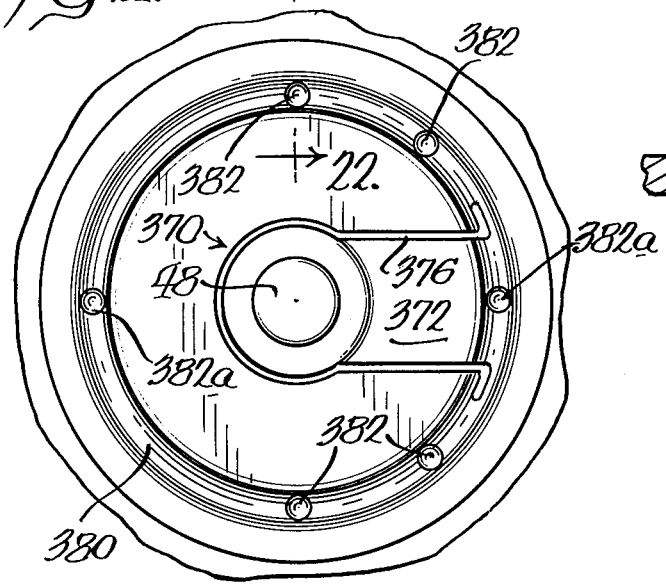
FIG. 21 (appearing with FIG. 5) is a fragmentary plan view similar to FIG. 15 showing a further modified form of tab or opening means.
Figure 22:
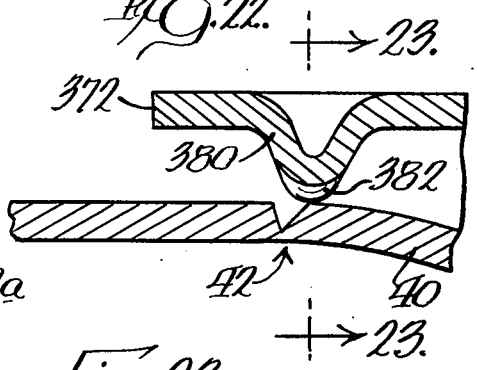
FIG. 22 is an enlarged fragmentary sectional view as viewed along line 22—22 of FIG. 21.
Figure 23:
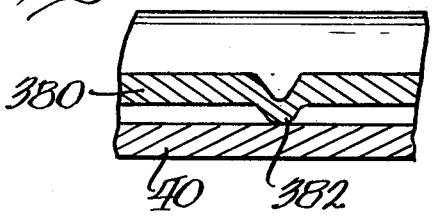
FIG. 23 is an enlarged sectional view as viewed along line 23—23 of FIG. 22.

A further modified form of tab construction is illustrated in FIGS. 21 through 23. In this embodiment removal means or tab 370 has a generally circular main body which has its periphery located outside the area of weakened line 42. Tab 370 has a tongue portion 372 that is produced by a generally U-shaped slit 376 and the free end of tongue portion or connecting means 372 is connected to rivet 48.

The body of tab 370 has a generally circular bead 380 deformed therein which is generally aligned with the inner edge of weakened line 42. Bead 380, which is generally U-shaped in cross section as illustrated in FIG. 22, has a plurality of projections 382 depending from the lower edge thereof at circumferentially spaced locations and projections 382 engage removable section 40 adjacent the inner edge of weakened line 42 as clearly illustrated in FIG. 22. Again, two projections **382*a* are aligned with the two areas of reduced residual R1 so that initial pressure applied to the top of tab 370** will cause the two areas of reduced residual to sever and continued pressure will result in severing the remainder of residual R.

The number of projections 382 and **382*a* and their locations may be varied and six such projections have been illustrated. Five of these projections have been indicated to be spaced apart 45 degrees circumferentially while the remaining projection is spaced 90 degrees from the two adjacent projections. If only one area of reduced residual R1 is used it is desirable that this area be located under tongue portion 372**.

Figure 24:
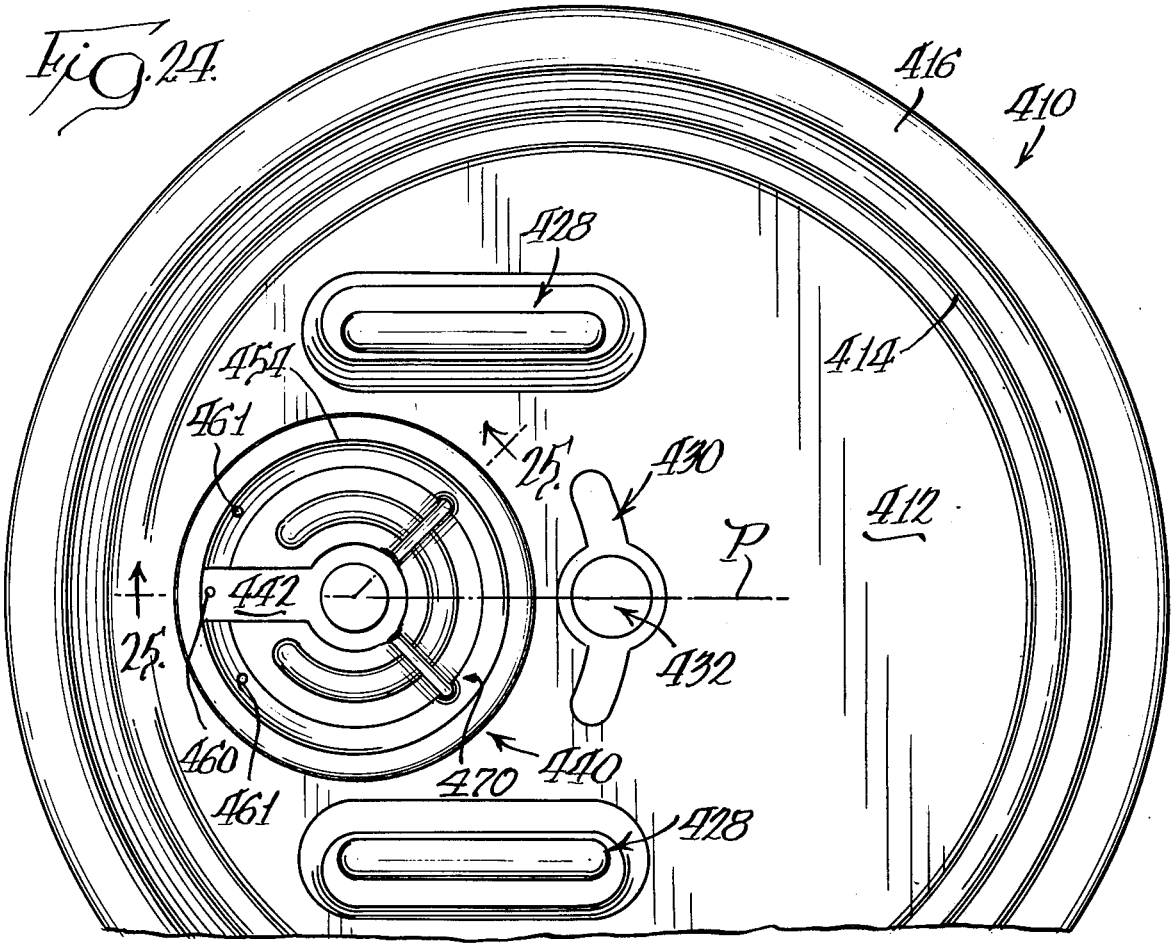
FIG. 24 is a fragmentary plan view of another modified form of tab.
Figure 25:
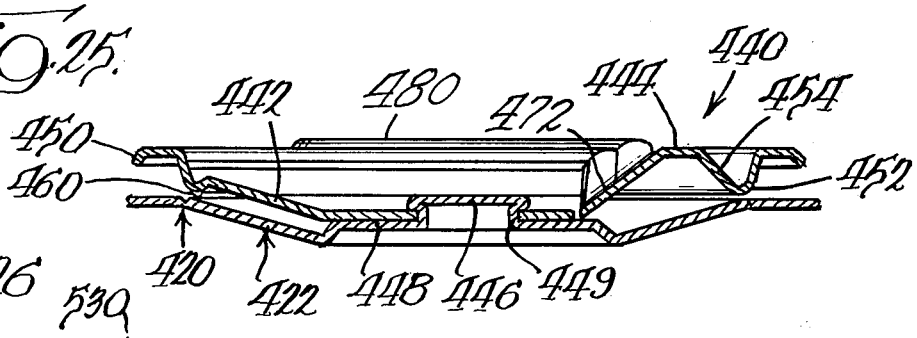
FIG. 25 is a fragmentary sectional view as viewed along line 25—25 of FIG. 24.

FIGS. 24 and 25 show a slightly modified form of the present invention. In this embodiment, the removable disc is formed in the same three step process described above. The end panel is generally disclosed in plan view in FIG. 24 and is generally designated by the reference numeral 410. End panel 410 again has a substantially central flat portion 412 with a countersink or trough 414 from the outer surface of flat central panel portion 412 and a flange 416 adapted to be seamed to the end of a container in a manner well known in the art.

Flat central panel portion 412 again has a closed score line 420 defined therein which produces a disc 422 that is completely severable from the remainder of end panel 412.

The removable section 422 again has reinforcing means similar to the reinforcing means disclosed and described above and consists of two elongated reinforcing members 428 that extend parallel to each other and parallel to a plane P that extends through the center of flat panel portion 412 and the center of removable disc 422. Also, the reinforcing means includes an arcuate reinforcing member 430 which has a raised central lock portion 432, for a purpose that will be described later.

A tab 440 is permanently attached to central flat panel portion 412 particularly to the removable disc 422 through a tongue portion 442 that is cut from the main body 444 of tab 440. Tab or opening member 440 is generally similar to tab 46 illustrated in FIG. 1 but is modified to incorporate primary and secondary contact means.

As illustrated in FIG. 25, the connecting means is in the form of an integral rivet 446 that is deformed in the central raised portion 448 and extends through an opening 449 in tongue portion or connecting means 442. Body 444 of tab 440 has a peripheral edge 450 which is located outside of the weakened line or score 420 and body 444 has an opening edge 452 spaced inwardly from peripheral edge 450 with opening edge or projection 452 extending towards disc 422 and aligned with the inner edge of weakened line 420. In the embodiment illustrated, the opening edge 452 is defined by an integral bead 454 which is deformed from body 444 and extends towards removable disc or tear portion 422 with the lower edge of bead 454 defining the opening edge or downwardly projecting portion 452.

The lower edge 452 of inwardly directed bead 454 has one or more projections 460 extending downwardly with at least one of these projections located directly above the inner edge of score line 422 in the area of the score line which is in closest proximity to the periphery of flat central panel portion 412, more particularly in tongue portion 442. In the embodiment illustrated, two more such projections 461 are spaced slightly around the perimeter of inwardly directed bead 454 and define further contact points between the inner edge of removable disc 122 and opening member or tab 440. The inwardly directed projection 460, which is aligned with the inner edge of the score line in the area which is in closest proximity to the downwardly directed trough 414, defines primary contact means or an end point contact means that will cause initial rupture of the weakened line when pressure is applied to the outer surface of tab 440.

In this embodiment of the present invention, tab 440 has secondary contact means 470 which are located inwardly of the weakened line and are initially spaced from the tear portion or removable disc. Preferably, the secondary contact means 470 engage the center raised portion 448 of disc 422 at a location opposite the center of the removable disc at which the primary contact means 460, 461 engage the disc. More specifically, the secondary engaging means and contact means 470 are located between the center of the removable disc 422 and the periphery of flat center raised portion 448 while the primary engaging means or projections 460, 461 are located between the center of the removable disc and the periphery of the circular flat central panel 412.

In this embodiment, the secondary engaging means or contact means 470 consist of inwardly directed beads 472 that are deformed from the main body and the beads 472 have their lower edges aligned with the periphery of the center raised portion 448 of disc 422.

To further reinforce the tab 440, it is preferable that the tab body 444 also has an upwardly directed bead 480 located between the downwardly directed bead 454 and the center opening defined by the tongue portion 442 cut from the main body of the tab.

The opening procedure for the end panel 410 illustrated in FIGS. 24 and 25 is generally similar to that described above in connection with the embodiments described above. Initial downward pressure from the thumb over the center portion of the tab will result in a localized force being developed at the primary contact means 460 adjacent the periphery of the central flat panel 412. This will cause an initial rupture of a localized area of the weakened line 420, which preferably has less residual than the remainder of the weakened score line 420.

After the initial rupture along or directly below the first primary contact point 460, the propagation or continuation of the rupture of the remainder of the score line will result from continued pressure on the upper surface of the tab which will be assisted by further contact points 461. During this continued propagation of the rupture, it has been found that the entire disc or removable section 422 will have a tendency to pivot downwardly. This downward pivotal movement of the severed portion of the tab will have a tendency to cause the contact means or bead 454 to be separated from the remainder of the disc to prevent complete severing of the score line. However, as the removable disc tends to move away from the tab, the secondary contact means 470 engage the removable disc at a location opposite the center of the removable disc and will continue the propagation of the score line until the entire disc 422 has been severed from the remainder of the central flat panel portion 412. After the removable disc 422 has been completely severed, tab and removable disc can be slid to a storage position wherein the rivet 446 is locked into the recess defined by the raised portion 432 of reinforcing means 430.

It has also been found that by forming the secondary engaging means 470 in the form of a sloping surface as illustrated in FIG. 25, these sloping surfaces will act as guides for initially guiding the periphery of the tab onto the outer surface of central panel portion 412 while the removable disc is guided below along the inner surface of the central flat panel portion 412.

While the secondary contact or engaging means 470 have been shown as being formed as an integral part of tab 440, it is readily apparent that this contact means could be produced by proper deformation of the removable disc 422, particularly the central raised portion 448. For example, the central raised portion 448 could have an upwardly directed bead along the rear circular portion thereof which would be aligned with the inner edge of the tab body defined by cutting the tongue 442 from the center thereof.

As can be appreciated, the construction of the removable section and the tab in the manner desired will allow the consumer to open the container by simply pushing on the tab and then producing a sliding motion to move the tab and removable section to the stored position. In all embodiments, the "drape angle" or small angle of inclination of the area directly outside score 62 will act as a ramp for guiding tabs 46, 246, 350 or 370 to a portion against upper surface of the flat wall portion of the end. In the stored position, the periphery of the removable section bears against the inside surface of the end panel while the tab bears against the outside surface of the panel. This virtually eliminates the possibility of the top surface of the removable section from being exposed to the contents of the container. Also, in the stored condition, the area of the tab from which tongue portion 202, 254 or 372 has been cut acts as a vent when the contents are being consumed.

Furthermore, the specific manner of forming the weakened line 20, more specifically, the specific sequence of steps described above, has been ascertained as being the only acceptable manner of producing a score line that can be opened by hand pressure and still be capable of withstanding the necessary pressures when a carbonated beer or beverage is packaged in the container.

Figure 26:
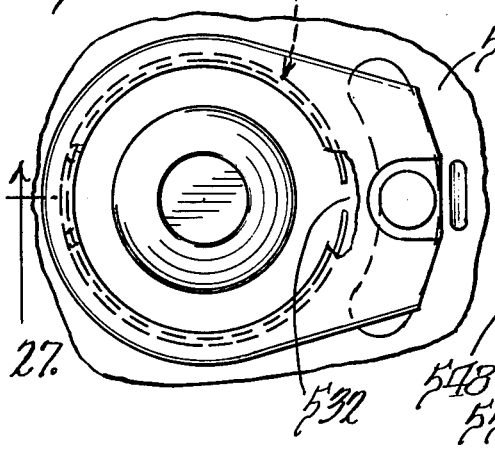
FIG. 26 is a fragmentary plan view of an end panel having a further modified form of tab opening member.
Figure 27:
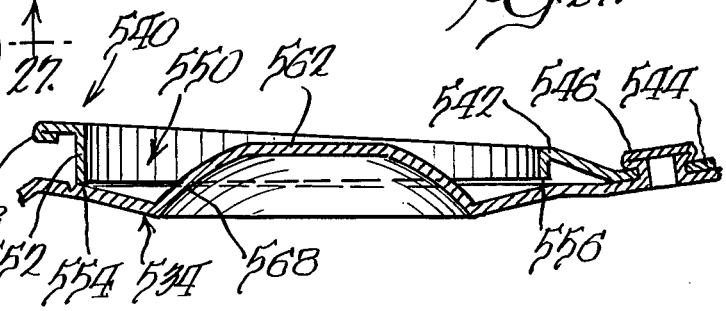
FIG. 27 is a cross-sectional view, as viewed along line 27—27 of FIG. 26.

A further modified form of opening member and removable section are illustrated in FIGS. 26 and 27. This modified form is described in more detail in copending application Serial No. 873,548, filed Jan. 30, 1978, which is incorporated herein by reference.

Since only the tab and the removable section vary from the embodiment of FIGS. 24 and 25, only the differences will be described. Score 530 is formed in the manner described above except that the score is interrupted at 532 to define a permanent connection between removable or severable section 534 and flat central panel portion 536.

In this embodiment, an opening member or tab 540 has a main body 542 extending across removable section 534 and has a connecting end 544 permanently attached to central panel portion 536 through an integral rivet 546. Main body 542 has a peripheral edge 548 located outside score or weakened line 530 and has an opening 550 located inside weakened line 530. The periphery of opening 550 has a flange 552 directed toward removable section 534 and the free edge of flange has a projection 554 which defines primary contact means between the removable section and the tab 540. The outer surface of flange 552 is aligned with the inner edge of weakened line 530 and the lower edge of flange 552 is tapered slightly from projection 554 on opposite sides to a highest point 556 located in closest proximity to rivet 546.

The removable section also has a center blister 560 extending towards tab 540 and located within opening 550. Blister or center portion 560 has a central flat portion 562 that is preferably aligned with or slightly below the upper surface of tab 540.

Removable section 534 is severed from panel portion 536 by applying pressure to the top surface of main body 548 of tab 540 and at the same time to flat portion 562 of removable section 534. The pressure applied by the thumb of a consumer will produce a localized force on weakened line 530 directly below projection 554 to produce an initial rupture at that point which preferably has a minimum residual R1. The continual rupture or propagation of the score line, after initial rupture, will result from the force applied to removable section 534 through blister 560 which may be assisted by the lower free edge of flange 552 contacting the upper or outer surface of removable section.

When the entire score line has been severed, high point 556 of the lower edge of flange 552 will engage removable section 534 along the permanent connection 532 and will cause removable section to be bent to a position extending generally perpendicular central panel portion 536. In the final position the major portion of the lower edge of flange 552 will be located below the edge of the opening created in the panel and will prevent contact of the sharp edge by a consumer drinking directly from the container. If desired, lock means may be provided between flange 552 and the edge of the opening created in the panel to lock the tab in the opening.

What is claimed is:

1. In a sheet metal end closure including a substantially flat wall portion having a removable section therein and an inner surface and an outer surface with the removal means permanently connected to said wall portion, said wall portion having a flat annular reduced portion with a score in said flat annular reduced portion defining said removable section, said score defining a reduced thickness of residual between said removable section and said wall portion, said residual having a substantially constant maximum thickness along a major portion thereof and at least one portion of less thickness than said major portion along a minor portion thereof, said removal means having a greater peripheral dimension than said removable section and having severing means for initially severing said at least one portion and subsequently said major portion of said residual.

2. A sheet metal end closure as defined in claim 1, in which said residual has two spaced portions of reduced thickness that are generally opposed to each other and said major portion includes first and second segments respectively between said two spaced portions.

3. A sheet metal end closure as defined in claim 1, in which removable section is circular.

4. A sheet metal end closure as defined in claim 1, in which said wall portion has a further annular reduced portion surrounding and spaced from said flat annular reduced portion.

5. A sheet metal end closure as defined in claim 1, in which said wall portion has at least two integral stiffening beads spaced from and on opposite sides of said removable section.

6. A sheet metal end closure as defined in claim 1, in which said removal which includes a peripheral portion extending substantially perpendicular to said wall portion and engaging said outer surface at a location spaced from said score and an inner deflectable portion adapted to engage said removable section to sever said residual.

7. A sheet metal end closure as defined in claim 6, in which said inner deflectable portion includes a plurality of downwardly directed segments spaced inwardly from said peripheral portion of said removal means, said segments being generally aligned with an inner edge of said score.

8. A sheet metal end closure as defined in claim 1, in which said removable section is circular and said removal means includes a body having a connecting portion severed from a center portion while being integral with the body adjacent the periphery thereof, said connecting portion being permanently secured to a center of said removable section, said body having a bead deformed towards said removable section and located within said score, and at least one projection extending from said body adapted to engage said removable section adjacent said at least one portion.

9. A sheet metal end closure as defined in claim 8, in which said bead terminates on opposite sides of said connecting portion and said at least one projection is located in said connecting portion.

10. A sheet metal end closure as defined in claim 9, in which said body has means for localizing pressure applied to said body to said projection.

11. A sheet metal end closure as defined in claim 9, in which said at least one projection defines primary contact means for initially rupturing said weakened line with secondary contact means between said removable section and said removal means, said secondary contact means assisting in continued rupture of said weakened line.

12. A sheet metal end closure as defined in claim 11, in which said removable section has a center portion off-set toward said removal means, and in which said body has spaced projections deformed therefrom toward said center portion to define said secondary contact means.

13. A sheet metal end closure as defined in claim 8, in which said bead is continuous and said at least one projection is located within said bead.

14. A sheet metal end closure as defined in claim 1, in which said wall portion has a further annular reduced portion surrounding and spaced from said flat annular reduced portion and in which at least an annular portion of an annular area between said reduced portions is inclined with respect to said wall portion so that said score is located below said further annular reduced portion.

15. A sheet metal end closure as defined in claim 14, in which said removable section is circular and is dish-shaped in cross section and the metal is in compression.

16. A sheet metal end closure as defined in claim 15, in which said permanent connection is located in the center of said removable section and in which a circular area of said removable section surrounding said permanent connection is flat.

17. A sheet metal end closure as defined in claim 16, in which said flat circular area is offset away from a base of said dish-shaped removable section.

18. A sheet metal end closure as defined in claim 17, further including reinforcing means in said flat wall portion at spaced locations around said removable section.

19. A sheet metal end closure as defined in claim 18, in which said reinforcing means includes first and second elongated reinforcing beads on opposite sides of said removable section and an arcuate bead spaced from said further annular reduced portion and located between said elongated beads.

20. A sheet metal end closure as defined in claim 19, in which said reinforcing means includes a recessed element between said elongated reinforcing beads spaced from said further annular reduced portion and in which said removable section and removal means are movable to a stored position wherein said permanent connection is located in said recessed element to maintain said removable section and removal means in said stored position.

21. A sheet metal end closure as defined in claim 1, in which said removable portion is circular and said removal means includes a substantially circular disc having a peripheral portion extending substantially perpendicular to said wall portion, said peripheral portion having a free end generally aligned with an inner edge of said score defining a surface, said free end surface being spaced from said disc by a maximum dimension adjacent said at least one portion and a minimum dimension on opposite sides of said at least one portion and spaced therefrom with said free end surface being inclined with respect to said removable section between the points of maximum dimension and minimum dimension so that force applied to said disc will initially sever said at least one portion and subsequently sever said residual on opposite sides of said at least one portion.

22. A sheet metal end closure including a central generally flat wall portion surrounded by a peripheral curl with a countersink between said peripheral curl and said flat wall portion, said flat wall portion having an upper and a lower surface, said flat wall portion having a first closed are of reduced thickness and said first closed area of reduced thickness having a weakened line defining a removable section, a second closed area of reduced thickness surrounding and spaced from said first closed area with an annular portion inwardly of said second closed area being inclined downwardly so that the upper surface of said annular portion defines a small acute angle with respect to said upper surface of said flat wall portion, said removable section being generally disc-shaped in cross section and having a flat central portion spaced below said upper and lower surfaces with the metal in said removable section being in compression so that said removable section expands when said weakened line is severed.

23. A sheet metal end closure as defined in claim 22, further including a tab consisting of a body having a peripheral dimension greater than said removable section, said body having a connecting tongue integral at one end with an opposite end permanently connected to said removable section, and mean depending from said body and engaging said removable section along an inner edge of said weakened line.

24. A sheet metal end closure as defined in claim 23, in which said means includes a downwardly directed bead deformed from said body with a lower edge of said bead aligned with said inner edge of said weakened line, said lower edge having at least one projection for applying a localized rupturing force when pressure is exerted on said main body.

25. A sheet metal end closure as defined in claim 23, in which said bead extends across said connecting tongue and said at least one projection is located in said connecting tongue.

26. A sheet metal end closure as defined in claim 25, in which said body has an upwardly directed second bead having an arcuate configuration in plan view and having enlarged portions at opposite ends thereof adjacent opposite edges of said connecting tongue.

27. A sheet metal end closure as defined in claim 26, in which said connecting tongue has a portion intermediate said ends located generally in a plane defined by said body.

28. A sheet metal end closure as defined in claim 22, in which said flat central portion is offset upwardly to produce a recessed area in the center of said removable section.

29. A sheet metal end closure as defined in claim 22, in which said flat central portion defines a lower edge of said removable portion.

30. A sheet metal end closure as defined in claim 22, in which said first and second closed areas of reduced thickness are circular and have a portion located in close proximity to said countersink.

31. A sheet metal end closure as defined in claim 30, further including reinforcing means in said flat wall portion diametrically opposed to said portion located in close proximity to said countersink and further first and second reinforcing members in said flat wall portion on opposite sides of said removable section.

32. A sheet metal end closure as defined in claim 30, further including a circular tab having a peripheral dimension greater than said removable section and having severing means aligned with an inner edge of said weakened line when pressure is applied to said tab.

33. A sheet metal end closure as defined in claim 22, further including a tab cooperating with said removable section for severing said weakened line, said tab having primary contact means for engaging said removable section directly inside said weakened line and secondary contact means for engaging said flat central portion.

34. In a sheet metal end closure including a substantially flat wall portion having a closed weakened line defining a removable disc therein and an inner and outer surface, said disc being generally concave in cross section between the outer and inner surfaces and having a center raised portion directed toward said outside surface, tab means for severing said weakened line, said tab means including a body having a peripheral edge located outside said weakened line, said body having a tongue severed from the center thereof with said tongue being permanently connected to said center raised portion of said removable disc, said body having an opening edge spaced inwardly from said peripheral edge and extending towards and aligned with an inner edge of said weakened line, said opening edge having at least one projection defining primary engaging means between said opening edge and said disc for applying a localized force to said disc to produce initially rupture of said weakened line, and secondary engaging means between said removable disc and said tab, said secondary engaging means being located inwardly of said opening edge and producing secondary contact after initial rupture of said weakened line by said primary engaging means.

35. A sheet metal end closure as defined in claim 34, in which said secondary engaging means is defined between said tab and said center raised portion of said disc.

36. A sheet metal end closure as defined in claim 35, in which said secondary engaging means includes a pair of spaced projections deformed from said body toward said center raised portion.

37. A sheet metal end closure as defined in claim 36, in which said flat wall portion is circular and said disc is circular and is located between the center and periphery of said flat wall portion and in which said primary engaging means is aligned with the area of said weakened line in closest proximity to said periphery of said flat wall portion on one side of the center of said tab and said pair of spaced projections are located on an opposite side of the center of the tab.

38. A metal end panel for a container including a central generally flat wall portion having an upper and a lower surface, said flat wall portion having a first closed coined area of reduced thickness and said first coined area having a score line defining a removable section, a second closed coined area of reduced thickness surrounding said first area and being spaced therefrom, said removable section being generally disc-shaped in cross section and having a flat central portion with the metal in said removable section being in compression so that said removable section expands when said weakened line is severed to maintain said removable section below said lower surface.

39. A metal end panel as defined in claim 38, in which said first and second coined areas are circular in plan view, further including a tab extending across said upper surface and having means for severing said score line.

* * * * *

UNITED STATES PATENT AND TRADEMARK OFFICE

CERTIFICATE OF CORRECTION

PATENT NO. : 4,132,328

DATED : January 2, 1979

INVENTOR(S) : Arthur P. Zundel

It is certified that error appears in the above-identified patent and that said Letters Patent are hereby corrected as shown below:

Column 2, line 36, insert a period after "line".

Column 3, line 64, after "section" delete the period and substitute a --semicolon--.

Column 4, line 14, "weakeded" should read --weakened--.

Column 4, line 55, "defines" should read --defined--.

Column 6, line 16, "ceter" should read --center--.

Column 12, line 50, "245" should read --246--.

Column 12, line 51, "areas" should read --area--.

Column 13, line 15, "58" should read --358--.

Column 15, line 13, "122" should read --422--.

Claim 6, Column 18, line 10, "which" should read --means-- (second occurrence).

Claim 22, Column 19, line 47, "are" should read --area--.

UNITED STATES PATENT AND TRADEMARK OFFICE

CERTIFICATE OF CORRECTION

PATENT NO. : 4,132,328

DATED : January 2, 1979

INVENTOR(S) : Arthur P. Zundel

It is certified that error appears in the above-identified patent and that said Letters Patent are hereby corrected as shown below:

Claim 23, Column 19, line 66, "mean" should read --means--.

Claim 34, Column 20, line 66, "initially" should read --initial--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*